US009976238B2

(12) United States Patent
Morimoto et al.

(10) Patent No.: US 9,976,238 B2
(45) Date of Patent: May 22, 2018

(54) SEWING MACHINE

(71) Applicant: JANOME SEWING MACHINE CO., LTD., Hachioji-shi, Tokyo (JP)

(72) Inventors: Shuzo Morimoto, Hachioji (JP); Jun Mafune, Kokubunji (JP)

(73) Assignee: JANOME SEWING MACHINE CO., LTD., Hachioji-Shi, Tokyo (JP)

( * ) Notice: Subject to any disclaimer, the term of this patent is extended or adjusted under 35 U.S.C. 154(b) by 259 days.

(21) Appl. No.: 14/863,726

(22) Filed: Sep. 24, 2015

(65) Prior Publication Data

US 2016/0289875 A1 Oct. 6, 2016

(51) Int. Cl.

| | |
|---|---|
| ***D05B 19/00*** | (2006.01) |
| ***D05B 3/02*** | (2006.01) |
| ***D05B 55/14*** | (2006.01) |
| ***D05B 69/00*** | (2006.01) |

(52) U.S. Cl.

CPC ..... *D05B 19/003* (2013.01); *D05B 3/02* (2013.01); *D05B 19/00* (2013.01); *D05B 55/14* (2013.01); *D05B 69/00* (2013.01)

(58) Field of Classification Search

CPC ..... D05B 19/105; D05B 19/00; D05B 37/04
See application file for complete search history.

(56) References Cited

U.S. PATENT DOCUMENTS

| | | | | |
|---|---|---|---|---|
| 2,662,495 | A | 12/1953 | Parry | |
| 4,771,715 | A | 9/1988 | Inagaki | |
| 9,605,366 | B2 * | 3/2017 | Koike | D05B 57/32 |

FOREIGN PATENT DOCUMENTS

| | | | |
|---|---|---|---|
| CN | 87214806 | U | 9/1988 |
| CN | 1070699 | A | 4/1993 |
| EP | 1 972 710 | A1 | 9/2008 |
| GB | 08706 | A | 4/1914 |
| GB | 2 073 794 | A | 10/1981 |
| JP | S59-67991 | A | 4/1984 |
| JP | 1-42229 | B2 | 9/1989 |
| TW | 470800 | B | 1/2002 |
| TW | 201247958 | A | 12/2012 |

OTHER PUBLICATIONS

European Search Report issued in corresponding European patent application No. 15185872.7 dated Nov. 13, 2015.
TW office action dated Dec. 1, 2016 for corresponding TW application 104127786.

* cited by examiner

*Primary Examiner* — Tejash Patel
(74) *Attorney, Agent, or Firm* — Nath, Goldberg & Meyer; Jerald L. Meyer

(57) ABSTRACT

A sewing machine moves a needle up and down relative to a cloth based on drive force from a rotating upper shaft to form a stitch. A first output generating unit reciprocates a first output point along an output axis so as to convert the rotational motion of the upper shaft into a linear motion. An assist rod that serves as a connection portion links the first output point with a needle bar. A needle-bar swing unit swings the needle bar. An output shaft moving unit moves a guide that is the output axis in a cloth feeding direction in accordance with the motion of the needle-bar swing unit. The assist rod changes the inclination in accordance with the movement of the output axis, and reciprocates the needle bar in substantially parallel with the output axis while maintaining the inclination.

5 Claims, 13 Drawing Sheets

WHEN OPERATED IN R DIRECTION

WHEN OPERATED IN L DIRECTION

SEWING MACHINE

CROSS-REFERENCE TO RELATED APPLICATION

This application is based upon and claims the benefit of priority from Japan Patent Application No. 2015-075341, filed on Apr. 1, 2015, the entire contents of which are incorporated herein by reference.

FIELD OF THE INVENTION

The present invention relates to a sewing machine that can form zig-zag stitches by swinging a needle bar from side to side relative to a cloth feeding direction.

BACKGROUND

Sewing machines are known which form stitches of a zig-zag pattern and a lettering pattern by swinging a needle bar from side to side relative to a cloth feeding direction. According to such sewing machines, the needle bar swings from side to side in accordance with an up-and-down motion of the needle bar. Hence, the needle bar is located at the right and left needle drop positions.

Sewing machines are provided with a needle drop hole in a stage on which a cloth is placed. In the case of sewing machines that swing the needle bar from side to side, the needle drop hole extends in an orthogonal direction to the cloth feeding direction. The needle bar can swing in the direction in which the needle drop hole extends. By swinging the needle bar, a needle can fall to an arbitrary location within the needle drop hole.

In this case, a position of the needle relative to the needle drop hole is called abase line. For example, the position of the needle when the needle falls to the center in the needle drop hole is called a center base line. The position of the needle when the needle falls to the left side in the needle drop hole is called a left base line. The position of the needle when the needle falls to the right side in the needle drop hole is called a right base line. In this case, the right and left sides are defined with reference to the cloth feeding direction.

Sewing machines include a swing mechanism that swings the needle bar from side to side relative to the cloth feeding direction. This swing mechanism changes the base line of the needle. The swing mechanism can change the position of the needle from the left base line to the right base line, and from the right base line to the left base line. By changing the base line in this way, stitches for a zig-zag shape can be formed.

In addition, the swing mechanism can adjust the width of the swing of the needle bar from side to side. By adjusting the swing width of the needle bar, the width of zig-zag sewing can be adjusted. Still further, such sewing machines can realize complex sewing, such as whip stitch, pattern stitch, and letter stitch.

When, however, wide zig-zag sewing or pattern sewing is performed, the swing of the needle bar by the swing mechanism becomes large. In this case, the pitch between the needle drop position at the center base line and the needle drop positions at the right and left needle drop positions increases. According to typical sewing machines, even if the base line is changed, the position of a shuttle that retains thereinside a lower thread does remains the same. In this case, when the base line of the needle changes, the relative positional relationship between the needle and the shuttle changes. That is, the interaction between the needle and the shuttle becomes out of synchronization.

The needle and the shuttle are adjustable so as to form a stitch with a certain margin range. When, however, this non-synchronization in the interaction occurs beyond the margin range, it becomes difficult to form a stitch. Hence, according to conventional sewing machines, the amount of swing of the needle bar is limited within a range that still enables the non-synchronization of the interaction between the needle and the shuttle to form a stitch.

Conversely, for example, JP H01-42229 A discloses a scheme of causing a phase shifting when a rotational motion is converted into a linear motion by utilizing a positional change of the needle bar caused by the swing of the needle bar, and controlling the timing of the up-and-down motion of the needle bar, thereby reducing the non-synchronization of the interaction between the needle and the shuttle while increasing the amount of swing of the needle bar.

According to the scheme disclosed in JP H01-42229 A, however, the positional relationship among respective components that construct a sewing machine is significantly limited. Hence, the scheme of JP H01-42229 A is applicable to industrial sewing machines, but in view of the work positional relationship of normal domestic sewing machines, sewing machines become zig-zag sewing machines that move the needle bar back and forth relative to a user. Hence, it is not practical to apply the above scheme to normal domestic sewing machines.

SUMMARY OF THE INVENTION

The present invention has been proposed to address the above technical problems of conventional technologies, and it is an objective of the present invention to provide a sewing machine that can correct an out-of-timing between a needle and a shuttle caused when a needle bar swings from side to side relative to a cloth feeding direction to be within a range that still enables a formation of stitches with a simple structure.

In order to accomplish the above objective, a sewing machine according to an aspect of the present invention moves, relative to a cloth, a needle attached to a needle bar up and down based on drive force from a rotating upper shaft to form a stitch, and the sewing machine includes:

- a needle-bar swing unit swinging the needle bar in an orthogonal direction to a cloth feeding direction;
- a first output generating unit reciprocating a first output point along an output axis that swings in accordance with a swing operation of the needle bar by the needle-bar swing unit;
- a link unit linking the first output point with the needle bar; and
- an output axis moving unit moving the output axis in the cloth feeding direction in accordance with an operation of the needle-bar swing unit,
- in which the link unit changes an inclination in accordance with a movement of the output axis, and moves up and down the needle bar in substantially parallel with the output axis while maintaining the inclination.

The first output generating unit may include: a crank provided at the upper shaft; and a crank rod connected with the crank, and a leading end of the crank rod may serve as the first output point.

The needle-bar swing unit may include: a second output generating unit moving a second output point in an orthogonal direction to the cloth feeding direction; and a swing rod transferring a change in a position of the second output point to the needle bar.

The output axis moving unit may include a guide which is connected with the swing rod, and which rotates around and moves relative to a guide shaft extending in a vertical direction, and the leading end of the crank rod may move in accordance with a movement of the guide.

The guide may include two arms each forming a constant angle; one of the arms may be connected so as to be freely rotatable relative to the swing rod; a vertical axis in parallel with the guide shaft may be disposed at a leading end of the other arm; and the leading end of the crank rod may be connected so as to be freely rotatable relative to the vertical axis.

The sewing machine may further include a shuttle supplying a lower thread while rotating in a horizontal or vertical direction, in which, when the needle bar rotates in an opposite direction to a rotation direction of the shuttle, the vertical shaft may swing so as to come close to the shuttle.

According to the present invention, by changing the motion trajectory of the needle so as to correspond to the swing of the needle bar, a change in sewing condition (needle displacement) caused due to a change in the position relationship between the needle and the shuttle can be corrected. Hence, even if the width of the swing is increased, an appropriate stitch can be formed. In addition, the above effects can be accomplished without a large modification to the structure of conventional sewing machines.

DETAILED DESCRIPTION OF THE EMBODIMENTS

1. First Embodiment

Embodiments of the present invention will be explained below with reference to the figures. The following explanation will be given while focusing on the following features (3) to (5):

(1) General structure;

(2) Controller C;

(3) Needle-bar up-and-down swing unit A that swings a needle bar 1 up and down;

(4) Needle-bar side-to-side swing unit that swings the needle bar 1 from side to side; and (5) Needle-bar phase correcting unit that corrects the phase of up-and-down motion of the needle bar 1.

The explanation for the detailed structure of a sewing machine other than the above (1) to (5) will be omitted, but embodiments of the present invention are applicable to all sewing machines available currently or in future like zig-zag sewing machines.

[1-1. Structure]

(1) General Structure

Figure 1:
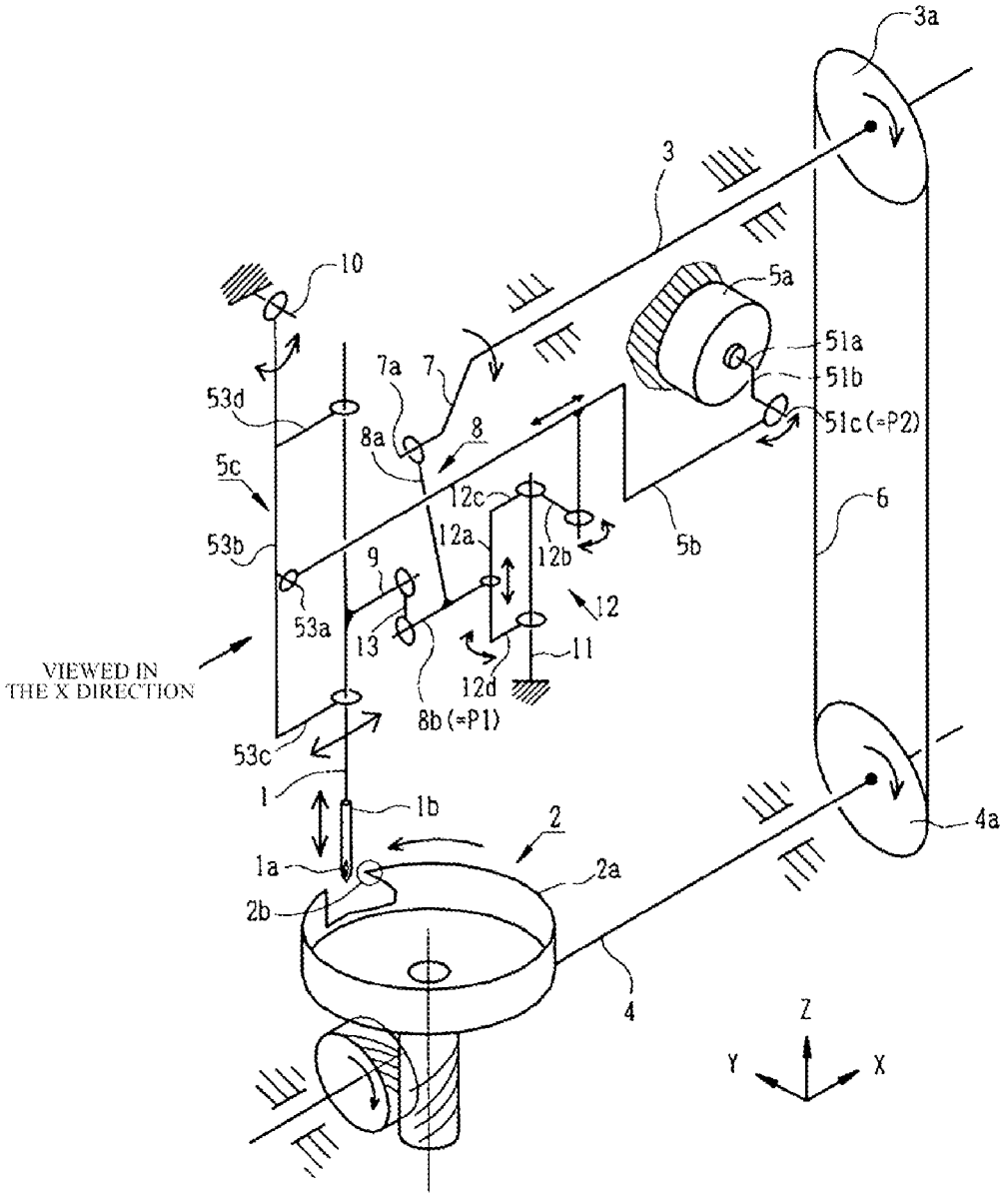
FIG. 1 is a line drawing illustrating an internal structure of a sewing machine according to an embodiment.

FIG. 1 is a line drawing illustrating an internal structure of a sewing machine of this embodiment. In FIG. 1, a cloth feeding direction, an orthogonal direction to the cloth feeding direction, and a vertical direction are defined as a Y direction, an X direction, and a Z direction, respectively. As illustrated in FIG. 1, a sewing machine includes a needle bar 1 and a shuttle 2. The needle bar 1 supports a needle 1*b* with a needle hole 1*a* in which an upper thread is inserted. An unillustrated thread take-up lever supplies the upper thread to the needle 1*b* from a thread supply source. The thread take-up lever changes an amount of supplied upper thread to the needle bar 1*b*. The shuttle 2 includes an unillustrated inner shuttle that retains thereinside a bobbin around which a lower thread is wound, and, an outer shuttle 2*a* that catches the upper thread. The outer shuttle 2*a* catches the upper thread through a tip 2*b*. Drive force from an unillustrated first motor 5 rotates an upper shaft 3, and the rotational motion is transferred to the needle bar 1 and the unillustrated thread take-up lever. In addition, the rotational motion of the upper thread 3 is also transferred to a lower shaft 4 through a toothed pulley 3*a*, a toothed pulley 4*a*, and a toothed belt 6, and is transferred to the shuttle 2 and an unillustrated cloth feeding mechanism.

(2) Controller C

Figure 2:
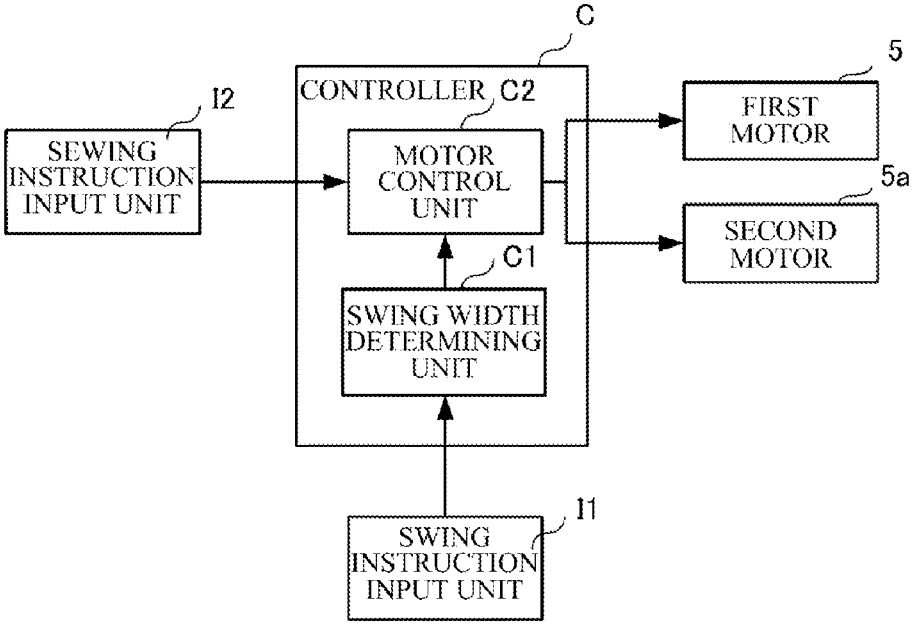
FIG. 2 is a block diagram illustrating a structure of a controller of the sewing machine according to the embodiment.

FIG. 2 is a diagram illustrating a structure of a controller C of the sewing machine of this embodiment. The sewing machine of this embodiment includes the controller C to form stitches in accordance with the size of zig-zag sewing specified by a user. The controller C includes a swing width determining unit C1 and a motor control unit C2. This controller C is connected with a swing instruction input unit I1 and a sewing instruction input unit I2.

The swing instruction input unit I1 receives an amplitude of swing desired by the user. The swing instruction input unit I1 outputs signals in accordance with the received amplitude of swing. The swing instruction input unit I1 is an input interface that includes, for example, a touch panel, a mechanical dial, and an adjust knob.

The sewing instruction unit I2 receives a sewing instruction from the user. The sewing instruction input unit I2 outputs signals in accordance with the received sewing instruction. The sewing instruction input unit I2 is an input interface that includes, for example, a foot controller and a switch of the sewing machine.

The swing width determining unit C1 determines the amount of swing of the needle bar 1 in accordance with the user's desire. The swing width determining unit C1 receives signals from the swing instruction input unit I1. Next, the amount of swing in accordance with the signals is determined. The determined amount of swing is transmitted to the motor control unit C2.

The motor control unit C2 outputs drive instructions to the first motor 5 and a second motor 5*a*. The drive instruction to be output is determined in accordance with the signals from the sewing instruction input unit I2 and the amount of swing from the swing width determining unit C1.

Figure 3:
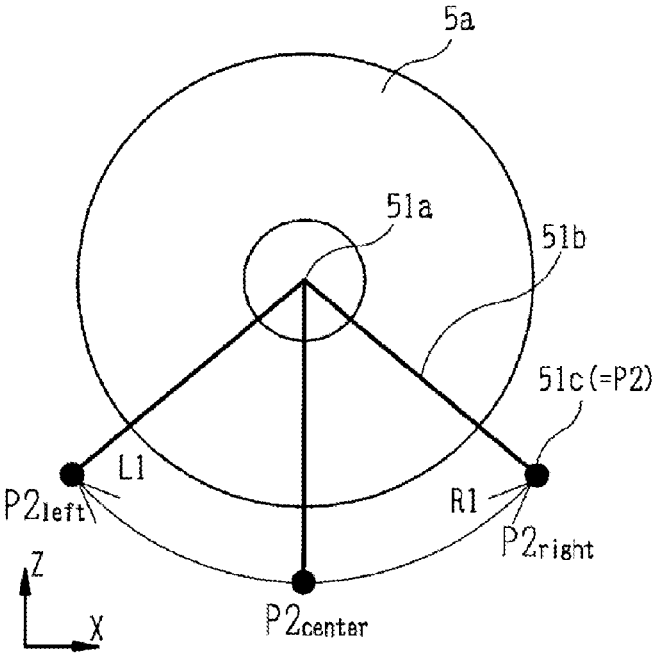
FIG. 3 is a diagram illustrating a moving position of a connection portion of a motor-shaft crank of a second motor 5*a* in the sewing machine of the embodiment.

FIG. 3 is a diagram illustrating a moving position of a connection portion of a motor-shaft crank of the second motor 5*a*. The second motor 5*a* transfers drive force to an output point P2, and moves the position. The second motor 5*a* changes the position to which the output point P2 is moved in accordance with the amount of swing from the swing width determining unit C1.

(3) Needle-Bar Up-and-Down Swing Unit A

A needle-bar up-and-down swing unit A includes the first motor 5, the upper shaft 3, a needle-bar crank 7, a needle-bar crank rod 8, an assist rod 13, a needle-bar holder 9, and the needle bar 1. The upper shaft 3 and the needle bar 1 are linked with each other through the needle-bar crank 7, the needle-bar crank rod 8, the assist rod 13, and the needle-bar holder 9. Drive force from the upper shaft 3 is transferred to the needle bar 1.

The upper shaft 3 is freely rotatably supported by an unillustrated bearing fastened to the interior of the sewing machine. The upper shaft 3 has a rotational axis in the orthogonal direction (X direction in FIG. 1) to the cloth feeding direction. Drive force from the first motor 5 is transferred to the upper shaft 3, and the upper shaft 3 rotates around the rotational axis. The needle-bar crank 7 is provided at the leading end of the upper shaft 3.

The needle-bar crank 7 is one end of the upper shaft 3 bent at a substantially right angle. The needle-bar crank 7 synchronously rotates with the upper shaft 3. A connection portion 7*a* with the needle-bar crank rod 8 is provided at the leading end of the needle-bar crank 7. The connection portion 7*a* is the leading end of the needle-bar crank 7 bent at a substantially right angle. The connection portion 7*a* is an axis that extends in the orthogonal direction (X direction in FIG. 1) to the cloth feeding direction. The needle-bar crank 7 and the upper end of the needle-bar crank rod 8 are connected with each other through the connection portion 7*a*. The needle-bar crank rod 8 is connected so as to be freely rotatable around the connection portion 7*a*. In addition, the needle-bar crank rod 8 is connected so as to be slidable in the orthogonal direction (X direction in FIG. 1) to the cloth feeding direction along the connection portion 7*a*.

The needle-bar crank rod 8 is formed in a substantially T-shape upside down. The needle-bar crank rod 8 includes a vertical portion 8*a* and a horizontal portion 8*b*.

The vertical portion 8*a* is an axis that extends in the vertical direction (Z direction in FIG. 1). The needle-bar crank rod 8 is connected to the upper end of the vertical portion 8*a*. In addition, the horizontal portion 8*b* is located at the lower end of the vertical portion 8*a*.

The horizontal portion 8*b* is a bar member that extends in parallel with the upper shaft 3, i.e., the orthogonal direction (X direction in FIG. 1) to the cloth feeding direction. The one end of the horizontal portion 8*b* is connected with a vertical shaft 12*a* of a guide 12. The horizontal portion 8*b* is slidable in the vertical direction along the vertical shaft 12*a*. In addition, the horizontal portion 8*b* is connected so as to be freely rotatable around the vertical shaft 12*a*.

As will be explained later, the vertical shaft 12*a* rotates around and moves relative to a guide shaft 11. At this time, the horizontal portion 8*b* also moves together with the vertical shaft 12*a*. The moving direction of the horizontal portion 8*b* by the movement of the vertical shaft 12*a* is consistent with the cloth feeding direction. In addition, the horizontal portion 8*b* before movement and the horizontal portion 8*b* after the movement are in parallel with each other. The direction of the horizontal portion 8*b* is maintained in the orthogonal direction (X direction in FIG. 1) to the cloth feeding direction although the position of the horizontal portion 8*b* is changed by the above structure.

The other end of the horizontal portion 8*b* is connected with the assist rod 13. The assist rod 13 is a bar member. The one end of the assist rod 13 is connected so as to be slidable along the horizontal portion 8*b*. In addition, the assist rod 13 is connected so as to be freely rotatable around the horizontal portion 8*b*. According to this structure, the assist rod 13 changes the inclination in accordance with a change in position of the horizontal portion 8*b* in the horizontal direction. Conversely, when the horizontal portion 8*b* translates in the vertical direction, the assist rod 13 is supported so as to have a constant inclination when viewed from the Y direction, i.e., from the cloth feeding direction (Y direction in FIG. 1). In FIG. 1, the horizontal portion 8*b* is disposed at a position that makes the assist rod 13 inclined in the vertical direction. In this condition, the horizontal portion 8*b* reciprocates in the vertical direction along the vertical shaft 12*a*. In this case, the assist rod 13 reciprocates in the vertical direction while being inclined in the vertical direction and maintaining the inclination. Hence, the needle bar 1 to which power in the vertical direction from the assist rod 13 is transferred through the needle-bar holder 9 reciprocates in the vertical direction together with the reciprocal motion of the horizontal portion 8*b* in the vertical direction.

As explained above, the first motor 5, the upper shaft 3, the needle-bar crank 7, the needle-bar crank rod 8, the assist rod 13, and the needle bar 1 construct the needle-bar up-and-down swing unit A. Drive force generated by the first motor 5 swings the needle bar 1 in the vertical direction through the upper shaft 3, the needle-bar crank 7, the needle-bar crank rod 8, and the assist rod 13. The upper shaft 3, the needle-bar crank 7, and the needle-bar crank rod 8 in the needle-bar up-and-down swing unit A can be considered as a slider crank mechanism.

Figure 4:
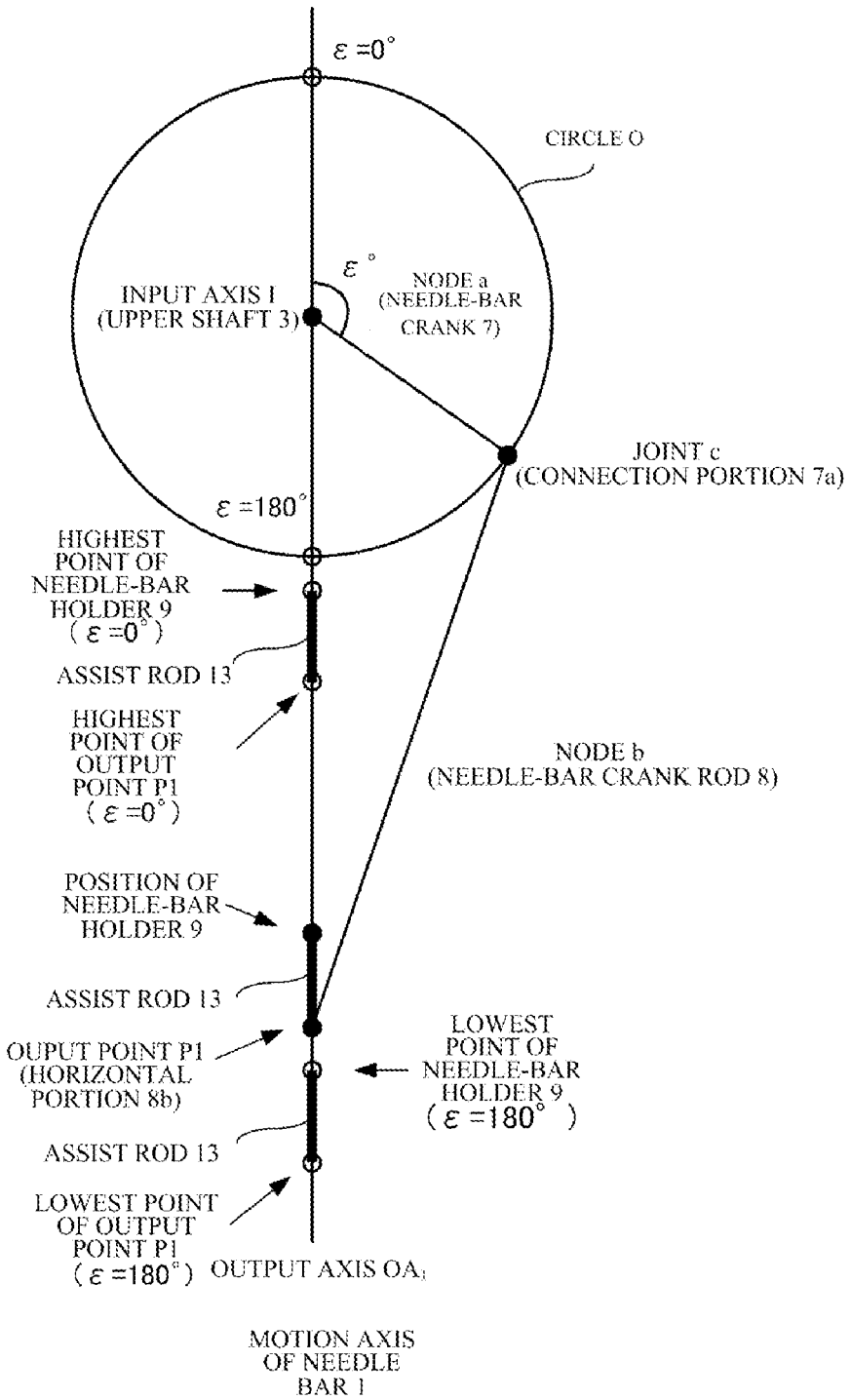
FIG. 4 is a diagram illustrating a positional relationship among an upper shaft, a needle-bar crank, and a needle-bar crank rod when a needle bar is located on the center base line in the sewing machine of the embodiment.

FIG. 4 is a diagram illustrating a positional relationship among the upper shaft 3, the needle-bar crank 7, and the needle-bar crank rod 8 when the needle bar 1 is located on the center base line. The vertical direction in FIG. 4 corresponds to the vertical direction (Z direction) in FIG. 1. The horizontal direction in FIG. 4 corresponds to the cloth feeding direction (Y direction) in FIG. 1. As illustrated in FIG. 4, the upper shaft 3, the needle-bar crank 7, the needle-bar crank rod 8, the connection portion 7*a* of the needle-bar crank 7, the horizontal portion 8*b* of the needle-bar crank rod 8, and the vertical shaft 12*a* can be considered as an input axis I, a node a, a node b, a joint c, an output point P1, and an output axis OA, respectively. In FIG. 4, when viewed in the X direction in FIG. 1, the output axis OA is located on the same plane as that of the upper shaft 3, i.e., intersects with the upper shaft 3. The output axis OA located at this position will be referred to as an output axis $OA_1$, and the horizontal portion 8*b* reciprocates on the output axis $OA_1$.

Figure 5:
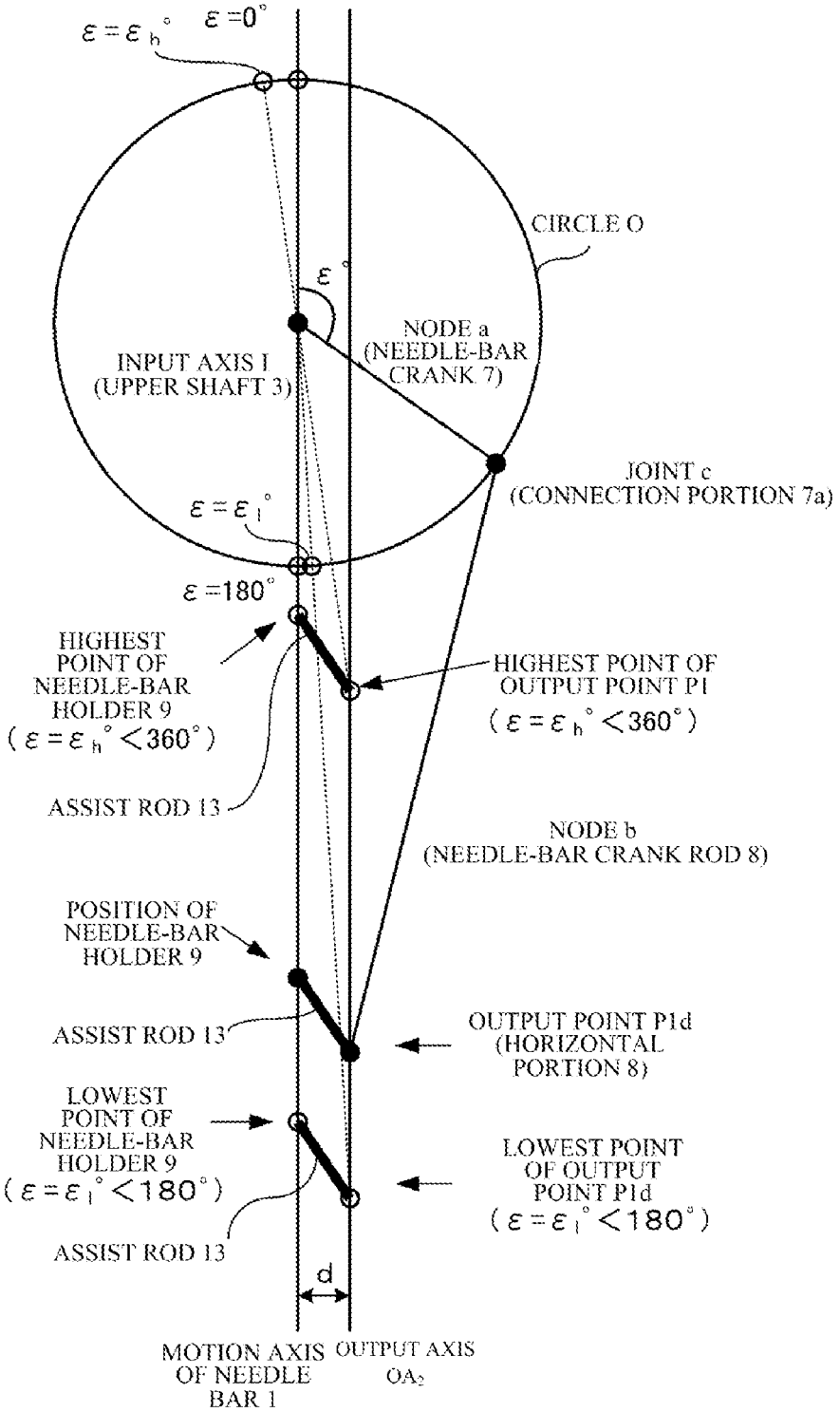
FIG. 5 is a diagram illustrating a positional relationship among the upper shaft, the needle-bar crank, and the needle-bar crank rod when the needle bar is located on the right base line in the sewing machine of the embodiment.

Conversely, the slider crank mechanism serves as an eccentric slider crank mechanism that translates the output axis OA from the output axis $OA_2$. FIG. 5 is a diagram illustrating a positional relationship among the upper shaft 3, the needle-bar crank 7, and the needle-bar crank rod 8 when the needle bar 1 is located on the right base line. According to the eccentric slider crank mechanism illustrated in FIG. 5, when viewed in the X direction in FIG. 1, the output axis OA is not located on the same plane as that of the upper shaft 3, i.e., does not intersect with the upper shaft 3. The output axis located at this position will be referred to as an output axis $OA_2$, and the horizontal portion 8*b* reciprocates on the output axis $OA_2$.

(4) Needle-Bar Side-to-Side Swing Unit

The needle-bar side-to-side swing unit includes the second motor 5*a*, a swing rod 5*b*, a needle bar support 5*c*, and the needle bar 1. The second motor 5*a* and the needle bar 1 are linked with each other through the swing rod 5*b*, and the needle-bar support 5*c*. Drive force from the second motor 5*a* is transferred to the needle bar 1 through those members.

The second member 5*a* is driven in accordance with an instruction from the controller C, and rotates a rotation shaft 51*a*. The second motor 5*a* can change the operation between a clockwise rotation operation that rotates the rotation shaft 51*a* in the clockwise direction, and a counterclockwise rotation operation that rotates the rotation shaft 51*a* in the counterclockwise direction.

The rotation shaft 51*a* of the second motor 5*a* is an axis that extends in the cloth feeding direction (Y direction in FIG. 1). A motor-shaft crank 51*b* is provided at the leading end of the rotation shaft 51*a*. The motor-shaft crank 51*b* is one end of the rotation shaft 51*a* bent at a substantially right angle. The motor-shaft crank 51*b* synchronously rotates with the rotation shaft 51*a*. A connection portion 51*c* with the swing rod 5*b* is provided at the motor-shaft crank 51*b*. The connection portion 51*c* is the leading end of the motor-shaft crank 51*b* bent at a substantially right angle. The connection portion 51*c* is an axis that extends in the cloth feeding direction (Y direction in FIG. 1). The second motor 5*a* transfers drive force with the connection portion 51*c* being as the output point P2, and moves the output point P2.

FIG. 3 is a diagram illustrating a trajectory of the connection portion 51*c* at the leading end of the motor-shaft crank 51*b*, i.e., the output point P2. When viewed in the cloth feeding direction (Y direction in FIG. 1), the connection portion 51*c* moves, on a Z-X plane, a circumference around the rotation shaft 51*a*. The connection portion 51*c* moves between a left base line point $P2_{left}$, a center base line point $P2_{center}$, and a right base line point $P2_{right}$, all located on the circumference. The left base line point $P2_{left}$ is a position of the connection portion 51*c* where the needle 1*b* is located on the left base line. The center base line point $P2_{center}$ is a position of the connection portion 51*c* where the needle 1*b* is located on the center base line. The right base line point $P2_{right}$ is the position of the connection portion 51*c* where the needle 1*b* is located on the right base line.

The motor-shaft crank 51*b* and the swing rod 5*b* are connected through the connection portion 51*c* that moves as explained above. The swing rod 5*b* is connected so as to be slidable in the cloth feeding direction (Y direction in FIG. 1) along the connection portion 51*c*. In addition, the swing rod 5*b* is also connected so as to be freely rotatable around the connection portion 51*c*. Hence, when the connection portion 51*c* that performs a rotational motion moves by a distance L in the orthogonal direction (X direction in FIG. 1) to the cloth feeding direction, the swing rod 5*b* also moves by the distance L in the orthogonal direction (X direction in FIG. 1) to the cloth feeding direction.

In addition, an arm 52*a* that extends in the vertical direction (Z direction in FIG. 1) is provided at the center of the swing rod 5*b*. The arm 52*a* is connected with a guide arm 12*b* of the guide 12 to be explained later. The guide arm 12*b* rotates around and moves relative to the guide shaft 11.

The swing rod 5*b* is connected with the needle-bar support 5*c* through a needle-bar-support holder 53*a*. The needle-bar support 5*c* includes the needle-bar-support holder 53*a*, a needle-bar support shaft 53*b*, a lower arm 53*c*, and an upper arm 53*d*. The needle-bar support shaft 53*b* is a bar member that extends in the vertical direction. The needle-bar support shaft 53*b* has an upper end connected with a shaft 10 that is fixed to the main body of the sewing machine. This shaft 10 is an axis that extends in the cloth feeding direction (Y direction in FIG. 1). The needle-bar support shaft 53*b* is freely rotatable around the shaft 10. The lower end of the needle-bar support shaft 53*b* is bent at a substantially right angle, and serves as the lower arm 53*c*. The lower arm 53*c* extends in the orthogonal direction (X direction in FIG. 1) to the cloth feeding direction. A connection portion with the needle bar 1 is provided at the lower arm 53*c*. In addition, the upper arm 53*d* is provided at the center of the needle-bar support shaft 53*b*. The upper arm 53*d* extends in the orthogonal direction (X direction in FIG. 1) to the cloth feeding direction. A connection portion with the needle bar 1 is provided at the leading end of the upper arm 53*d*. The lower arm 53*c* and the upper arm 53*d* slidably support the needle bar 1 in the vertical direction.

As explained above, the second motor 5*a*, the swing rod 5*b*, the needle-bar support 5*c*, and the needle bar 1 construct the needle-bar side-to-side swing unit. Drive force generated by the second motor 5*a* swings the needle bar 1 in the orthogonal direction (X direction in FIG. 1) to the cloth feeding direction through the swing rod 5*b* and the needle-bar support 5*c*.

(5) Needle-Bar Phase Correcting Unit

The needle-bar phase correcting unit includes the second motor 5*a*, the swing rod 5*b*, the guide 12, and the needle-bar crank rod 8. The second motor 5*a* and the needle-bar crank rod 8 are linked with each other through the swing rod 5*b* and the guide 12. The vertical shaft 12*a* that is the output axis OA of the horizontal portion 8*a* of the needle-bar crank rod 8 is moved by drive force generated by the second motor 5*a*.

The swing rod 5*b* is connected with the guide 12. The guide 12 rotates around the guide shaft 11 fastened to the sewing machine main body. The guide 12 includes the vertical shaft 12*a*, the guide arm 12*b*, an upper arm 12*c*, and a lower arm 12*d*.

The vertical shaft 12*a* is an axis that extends in the vertical direction (Z direction in FIG. 1) along the guide shaft 11. The vertical shaft 12*a* is connected with the horizontal portion 8*b* of the needle-bar crank rod 8. The vertical shaft 12*a* restricts the movement of the horizontal portion 8*b* of the needle-bar crank rod 8 which slides relative to the vertical shaft 12*a*. The vertical shaft 12*a* is connected through the upper arm 12*c* and the lower arm 12*d*. The guide shaft 11 is a bar member which is fastened to the sewing machine main body, and which extends in the vertical direction (Z direction in FIG. 1). The upper arm 12*c* and the lower arm 12*d* are connected so as to be freely rotatable around the guide shaft 11.

The guide arm 12*b* is a bar member that extends in the horizontal direction. The one end of the guide arm 12*b* is connected with the arm 52*a*. The arm 52*a* is an axis that extends in the vertical direction of the swing rod 5*b*. The guide arm 12*b* is connected so as to be freely rotatable around the arm 52*a*.

The other end of the guide arm 12*b* is connected with the upper arm 12*c*. The upper arm 12*c* and the guide arm 12*b* are connected with a fixed angle. The guide arm 12*b* has a portion which is connected with the arm 12*c* and which is also connected with the guide shaft 11. The guide arm 12*b* is connected so as to be freely rotatable around the guide shaft 11.

Drive force from the second motor 5*a* is transferred to the guide 12 through the swing rod 5*b*. The guide 12 rotates around the guide shaft 11 by this drive force. That is, when the swing rod 5*b* moves in the orthogonal direction (X direction in FIG. 1) to the cloth feeding direction by the distance L, the guide 12 performs a rotational motion by the distance L.

When the guide arm 12*b* rotates around and moves relative to the guide shaft 11, the upper arm 12*c*, the vertical shaft 12*a*, and the lower arm 12*d* synchronously move with the motion of the guide arm 12*b*. That is, since the guide arm 12*b* and the arm 12*c* are connected with the fixed angle, the upper shaft 12*c* synchronously rotates around the guide shaft 11 with the guide arm 12*b*. In addition, since the upper arm 12*c* and the vertical shaft 12*a* are connected with the fixed angle, the vertical shaft 12*a* synchronously moves around the guide shaft 11 with the upper arm 12*c*.

When viewed in the X direction in FIG. 1, the vertical shaft 12*a* translates while extending in the vertical direction. That is, even if it moves, the inclination of the vertical shaft 12*a* is constant. The movement of the vertical shaft 12*a* moves the output axis OA of the horizontal portion 8*b*.

As explained above, the second motor 5*a*, the swing rod 5*b*, the guide 12, and the needle-bar crank rod 8 construct the needle-bar phase correcting unit. Drive force generated by the second motor 5*a* translates the output axis OA of the horizontal portion 8*b* through the swing rod 5*b* and the guide 12.

[1-2. Action]

An operation of each unit of the sewing machine employing the above structure will be explained.

(1) Operation of Each Unit when Second Motor 5*a* is Driven

Figure 6:
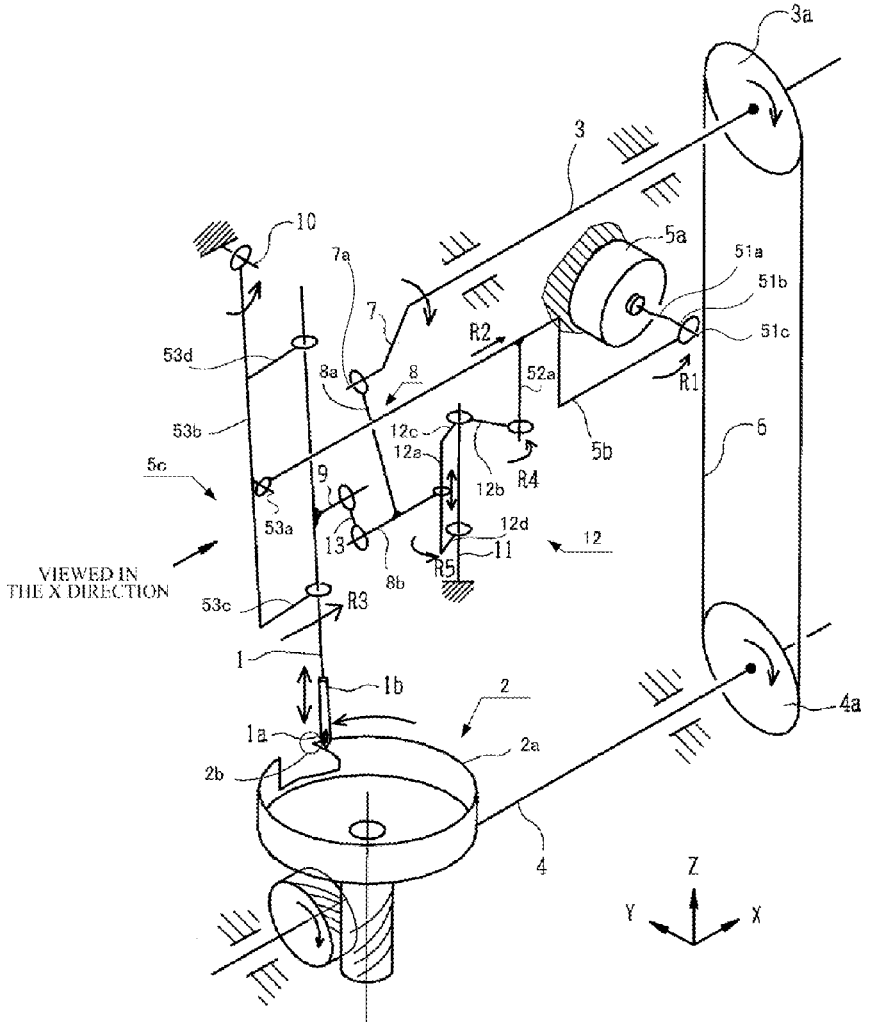
FIG. 6 is a line drawing illustrating an internal structure of the sewing machine of the embodiment when the needle is located on the right base line.

FIG. 6 illustrates a structure of the sewing machine when the connection portion 51*c* is located on the right base line point $P2_{right}$. In FIG. 6, the connection portion 51*c* is moving in the counterclockwise direction (an arrow R1) from the position illustrated in FIG. 1. Together with the movement of the connection portion 51*c*, the swing rod 5*b* moves in the orthogonal direction (an arrow R2) to the cloth feeding direction. The movement of the swing rod 5*b* also moves the needle-bar support 5*c* in the orthogonal direction (X direction in the figure) to the cloth feeding direction and to the right side (an arrow R3) relative to the cloth feeding direction. Accordingly, the needle bar 1 also moves to the right side (the arrow R3) relative to the cloth feeding direction.

The guide 12 linked with the swing rod 5*b* performs a rotational motion around the guide shaft 11 by the movement of the swing rod 5*b*. That is, the guide arm 12*b* of the guide 12 rotates around and moves relative to the guide shaft 11 in the clockwise direction (an arrow R4). The vertical shaft 12*a* that synchronously operates with the guide arm 12*b* rotates around and moves relative to the guide shaft 11 in the clockwise direction (an arrow R5). Accordingly, when viewed in the X direction, the vertical shaft 12*a* translates to the upstream side in the cloth feeding direction.

Figure 7:
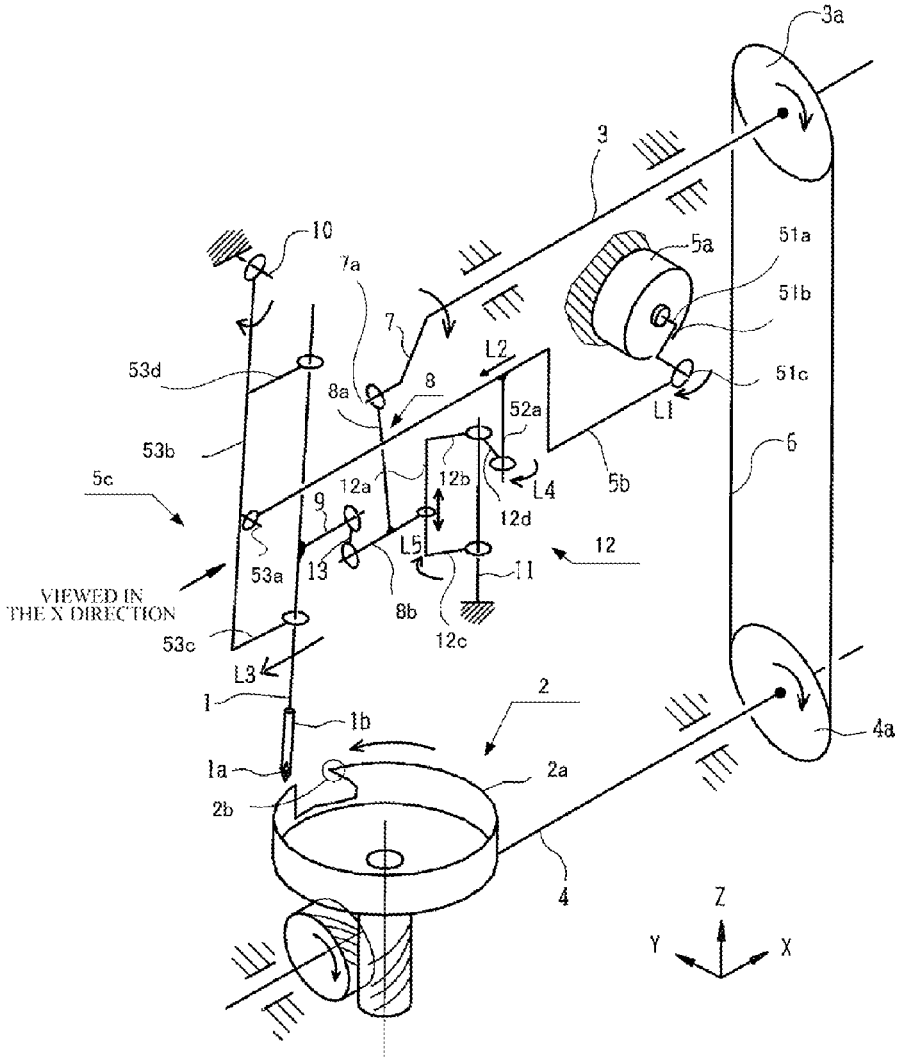
FIG. 7 is a line drawing illustrating an internal structure of the sewing machine of the embodiment when the needle is located on the left base line.

FIG. 7 is a line drawing illustrating a structure of the sewing machine when the connection portion 51*c* is located on the left base line point $P2_{left}$. In FIG. 7, the connection portion 51*c* is moving in the clockwise direction (an arrow L1) from the position in FIG. 1. Together with the movement of the connection portion 51*c*, the swing rod 5*b* moves in the orthogonal direction (an arrow L2) to the cloth feeding direction. The movement of the swing rod 5*b* also moves the needle-bar support 5*c* in the orthogonal direction (X direction in the figure) to the cloth feeding direction and to the left side (an arrow L3) relative to the cloth feeding direction. Accordingly, the needle bar 1 also moves to the left side (the arrow L3) relative to the cloth feeding direction.

The guide 12 linked with the swing rod 5*b* performs a rotational motion around the guide shaft 11 in the counterclockwise direction by the movement of the swing rod 5*b*. That is, the guide arm 12*b* of the guide 12 rotates around and moves relative to the guide shaft 11 in the counterclockwise direction (an arrow L4). The vertical shaft 12*a* that synchronously operates with the guide arm 12*b* rotates around and moves relative to the guide shaft 11 in the counterclockwise direction (an arrow L5). Accordingly, when viewed in the X direction, the vertical shaft 12*a* translates to the downstream side in the cloth feeding direction.

(2) Movement of Output Axis OA

In the following explanation, a difference between the output axis $OA_1$ when the connection portion 51*c* is located on the center base line point $P2_{center}$ and the output axis $OA_2$ when the connection portion 51*c* is located on the right base line point $P2_{right}$.

(2-1) Output Axis $OA_1$ on Center Base Line

As explained above, the input axis I in FIG. 4 corresponds to the upper shaft 3, the node a corresponds to the needle-bar crank 7, and the node b corresponds to the needle-bar crank rod 8. In addition, the joint c corresponds to the connection portion 7*a*, and the output point P1 corresponds to the horizontal portion 8*b*. In this case, the output point P2 that is the connection portion 51*c* of the motor-shaft crank is located on the center base line $P2_{center}$.

In FIG. 4, the input axis I rotates with a fixed position to a point. It is assumed that the rotation angle of the input axis I is $\epsilon$[°]. The one end of the node a is provided with the joint c. The node a synchronously rotates with the input axis I. The joint c moves on the circumference of a circle O which is around the input axis I and which has a radius that is the node a. In the circle O, the rotation angle of the input axis I when the joint c is located at the highest position in the vertical direction (Z direction) is defined as a reference angle ($\epsilon$=0°).

Drive force by the rotation of the input axis I is transferred to the output point P1 through the nodes a and b. The horizontal portion 8*b* of the needle-bar crank rod 8 which is the output point P1 has its movement restricted by the vertical shaft 12*a* in the vertical direction (Z direction). That is, through the vertical shaft 12*a*, the output point P1 reciprocates on an extended line passing through the input axis I and the lowest point of the circle O (ϵ=180°). An axis on which the output point P1 reciprocates will be defined as the output axis $OA_1$.

When the rotation angle of the input axis I is 0 [°], the joint c is located at the highest point. At this time, the output point P1 is located at the highest point of the output axis $OA_1$. In addition, when the rotation angle of the input axis I is 180 [°], the joint c is located at the lowest point. At this time, the output point P1 is located at the lowest point of the output axis $OA_1$.

Figure 8:
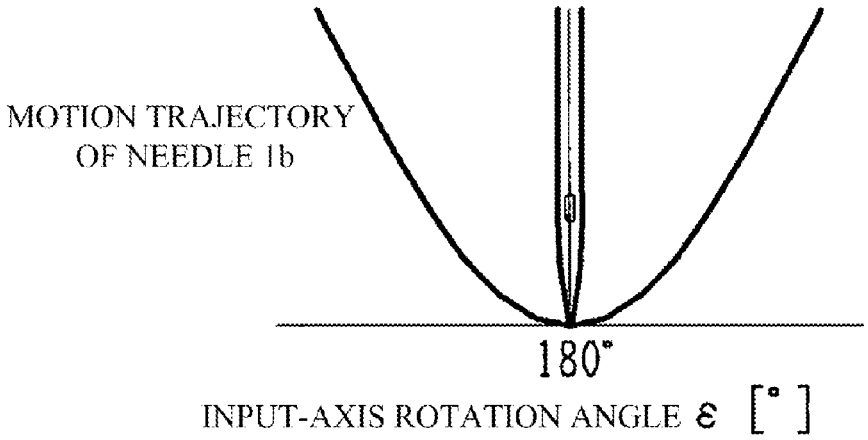
FIG. 8 is a diagram illustrating a motion trajectory near the lowest point of a needle when an output axis is located at $OA_1$ in the sewing machine of the embodiment.

In FIG. 4, the output axis $OA_2$ and the needle bar 1 overlap with each other. The horizontal portion 8*b* of the needle-bar crank rod 8 which is the output point P1 and the needle-bar holder 9 are linked through the assist rod 13. Hence, the horizontal portion 8*b* and the needle-bar holder 9 synchronously operate. That is, when the output point P1 is located at the highest point of the output axis $OA_1$ (ϵ=) 0°, the needle-bar holder 9 is located at the highest point of the motion axis. Conversely, when the output point P1 is located at the lowest point of the output axis $OA_2$ (ϵ=180°), the needle-bar holder 9 is located at the lowest point of the motion axis. FIG. 8 illustrates a trajectory (needle displacement) of the needle 1*b* around the input-axis rotation angle of ϵ=180 [°]. As illustrated in FIG. 8, at the input-axis rotation angle ϵ=180°, the needle 1*b* is located at the lowest point.

(2-2) Output Axis $OA_2$ of Needle-Bar Crank Rod on Left Base Line

FIG. 5 is a diagram illustrating a positional relationship among the upper shaft 3 (input axis I), the needle-bar crank 7 (node a), and the needle-bar crank rod 8 (node b) as viewed in the X direction when the connection portion 51*c* in FIG. 3 is located on the right base line point $P2_{right}$. In FIG. 5, the output axis OA is moved in the cloth feeding direction (Y direction) by a distance d from the position of the output axis $OA_2$. The output point in FIG. 5 will be defined as an output point P1*d*. An axis on which the output point P1*d* reciprocates will be defined as the output axis $OA_2$.

In FIG. 5, also, the input axis I rotates with a fixed position to a point. Drive force by the rotation of the input axis I is transferred to the output point P1*d* through the nodes a and b. The horizontal portion 8*b* of the needle-bar crank rod 8 which is the output point P1*d* has its movement restricted by the vertical axis 12*a* in the vertical direction (Z direction). The position of the vertical shaft 12*a* is moved by the distance d in parallel with the Y direction from the position in the case of the center base line. Hence, the position of the output axis $OA_2$ translates by the distance d relative to the output axis $OA_1$.

The output point P1*d* reciprocates on the output axis $OA_2$. The position of the output axis $OA_2$ is displaced from the extended line passing through the input axis I and the lowest point (ϵ=180°) of the circle O. Accordingly, unlike the case of the center base line in FIG. 4, even if the input-axis rotation angle is ϵ=0°, the output point P1*d* is not located at the highest point of the output axis $OA_2$. When the output point P1*d* is located at the highest point of the output axis $OA_2$, the node a and the node b overlap on a Y-Z plane. The rotation angle of the input axis at this time will be defined as ϵh [°]. Likewise, when the input-axis rotation angle is ϵ=180°, the output point P1*d* is not located at the lowest point of the output axis $OA_2$. When the output point P1*d* is located at the lowest point of the output axis $OA_2$, the node a and the node b do not overlap on the Y-Z plane but are aligned on a straight line. The input-axis rotation angle at this time will be defined as ϵ1 [°].

In FIG. 5, the output axis $OA_2$ and the needle bar 1 are distant from each other by the distance d. That is, on the Y-Z plane, the needle bar 1 is located on the extended line passing through the input axis I and the lowest point (ϵ=180°) of the circle O. In contrast, the output axis $OA_2$ is translated from the needle bar 1 by the distance d. In this case, the assist rod 13 causes the horizontal portion 8*b* and the needle-bar holder 9 to synchronously operate. In other words, the amount of movement of the horizontal portion 8*b* in the vertical direction and that of the needle-bar holder 9 are equal. That is, when the output point P1*d* is located at the highest point (ϵ=ϵh°) of the output axis $OA_2$, the needle bar 1 is also located at the highest point of the motion axis. In addition, when the output point P1*d* is located at the lowest point of the output axis $OA_2$ (input-axis rotation angle ϵ=ϵ1°), the needle bar 1 is also located at the lowest point of the motion axis.

Figure 9:
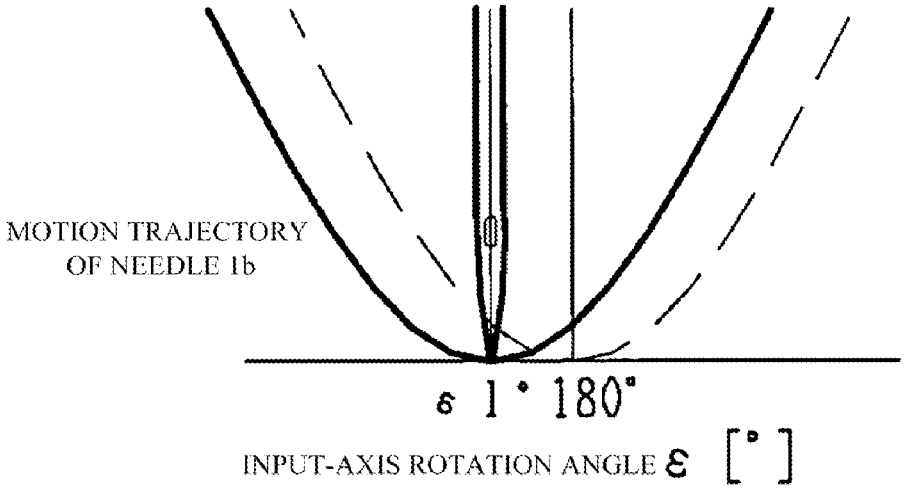
FIG. 9 is a diagram illustrating a motion trajectory near the lowest point of the needle when the output axis is located at $OA_2$ in the sewing machine of the embodiment.

FIG. 9 is a diagram illustrating a trajectory of the needle 1*b* around the input-axis rotation angle of ϵ=180°. As illustrated in FIG. 9, in comparison with the case of the center base line, the height of the lowest point of the needle 1*b* substantially remains the same, but a timing of becoming the lowest point is advanced. That is, when the rotation angle ϵ of the input axis is gradually increased from 0°, the position of the needle 1*b* gradually falls together with this increase in rotation angle. In addition, in a condition in which the input-axis rotation angle is ϵ=ϵ1°<180°, the needle 1*b* is located at the lowest point.

The height of the lowest point of the needle 1*b* at the input-axis rotation angle of ϵ1° becomes substantially consistent with the height of the lowest point of the needle 1*b* in the case of the center base line by the assist rod 13.

(2-3. Height Correction by Assist Rod)

The motion trajectory of the needle 1*b* is substantially in conjunction with the trajectory of the output point P1*d*, and the lowest point of the motion trajectory of the output point P1*d* is located at a higher position than the lowest point of the motion trajectory of the output point P1. Hence, the lowest point of the needle 1*b* on the right base line should be higher than the lowest point of the needle 1*b* at the center base line, but because the assist rod 13 corrects the position of the needle 1*b*, the height of the lowest point of the needle 1*b* on the right base line is substantially consistent with that of the lowest point of the needle 1*b* on the center base line. In the following explanation, the correction of the height of the needle 1*b* by the assist rod 13 will be explained.

Figure 10:
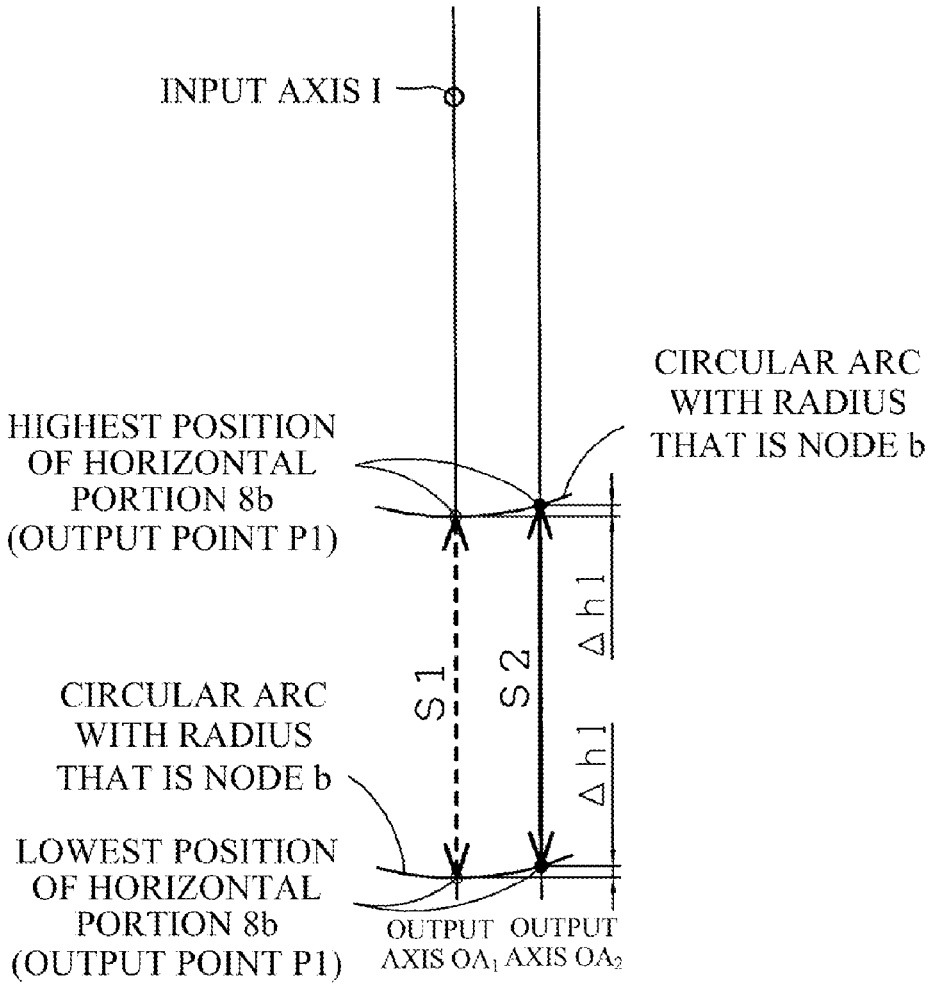
FIG. 10 is a diagram illustrating a change in needle-bar stroke S due to a change in output axis in the sewing machine of the embodiment.

FIG. 10 is a diagram illustrating a stroke range of the output point on the output axis $OA_1$ and on the output axis $OA_2$. In FIG. 10, a stroke S1 of the up-and-down movement of the output point P1 (horizontal portion 8*b*) of the output axis $OA_1$ that intersects the input axis I is indicated by arrows of a thick dotted line, and a stroke S2 of the up-and-down movement of the output point P1 (horizontal portion 8*b*) of the output axis $OA_2$ that does not intersect the input axis I is indicated by arrows of a thick solid line. As illustrated in FIG. 10, when the output axis OA is changed, the highest position and lowest position of the output point P1 (horizontal portion 8*b*) are each located on a circular arc that has a radius which is the node b, and S2 is shifted upward by the height of the camber (=Δh1) relative to S1.

Figure 11:
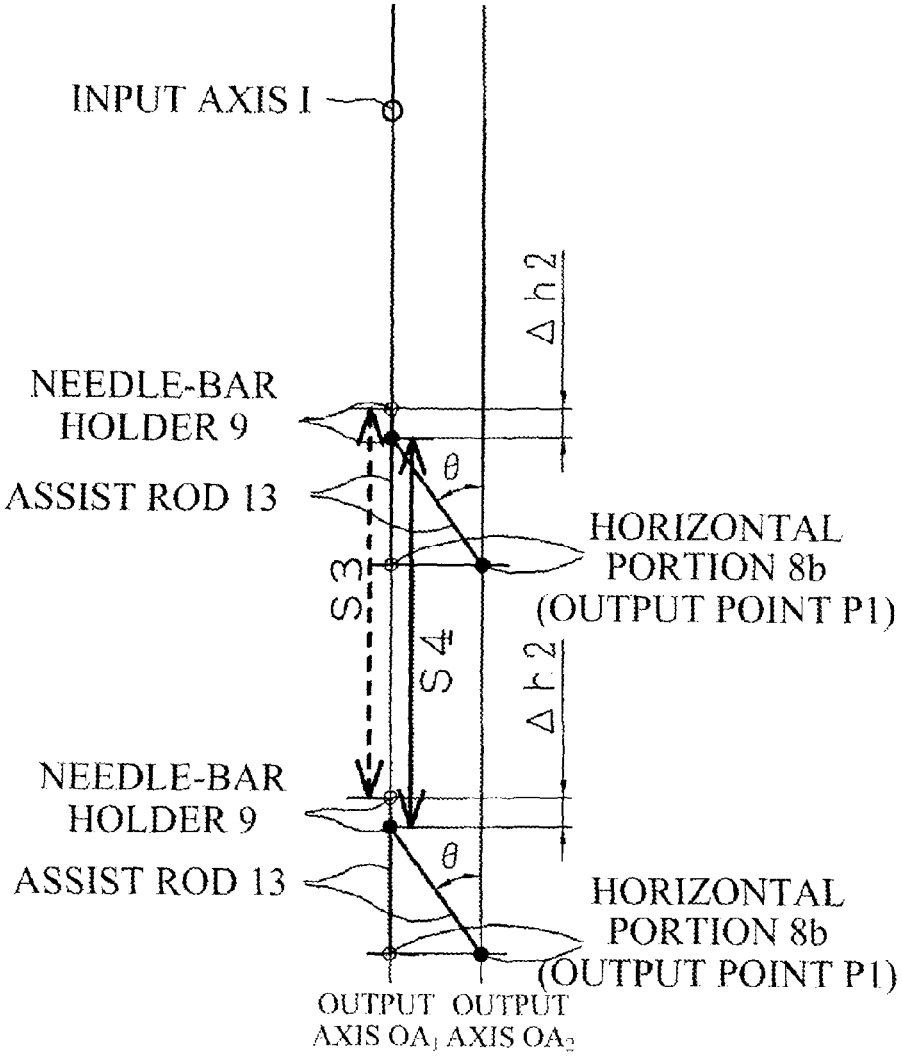
FIG. 11 is a diagram illustrating a change in needle-bar stroke S due to a change in inclination of an assist rod originating from a change in output axis.

Conversely, FIG. 11 is a diagram illustrating an inclination of the assist rod 13 and a stroke range of the needle-bar holder 9 in the cases of the output axis $OA_1$ and the output axis $OA_2$. In FIG. 11, for the purpose of explanation, it is assumed that the position of the output point P1 (horizontal portion 8*b*) maintains the same height even if the output axis OA changes. In FIG. 11, a stroke S3 of the up-and-down movement of the needle-bar holder 9 in the case of the output axis $OA_1$ that intersects the input axis I is indicated by arrows of a thick dotted line, and the stroke S2 of the up-and-down movement of the needle-bar holder 9 in the case of the output axis $OA_2$ that does not intersect the input axis I is indicated by arrows of a thick solid line. In this embodiment, when viewed in the X direction in FIG. 1, the needle bar 1 is coaxially disposed with the output axis OA. Hence, when the output axis OA is located on the $OA_1$, the output axis OA is located coaxially with the needle bar 1*b*. Accordingly, the assist rod 13 is also coaxially located, and transfers the up-and-down movement of the output point P1 to the needle bar 1*b*. Conversely, when the output axis OA is moved to the $OA_2$, the relative position between the output axis OA and the needle bar 1*b* changes. By the assist rod 13 that changes the inclination, the positional change can be compensated. Accordingly, as illustrated in FIG. 11, when the output axis OA is changed and the assist rod 13 is inclined by θ°, the stroke S4 shifts downward by the inclination of the assist rod 13 (Δh2=length of assist rod 13×(1−sin θ)) relative to the stroke S3.

In this embodiment, the upward shifting of the strokes S2 illustrated in FIG. 10 and the downward shifting of the stroke S4 illustrated in FIG. 11 act simultaneously. That is, the assist rod 13 changes the inclination in accordance with the change of the output axis OA, thereby accomplishing an action of correcting the upward shifting of the stroke S2 caused by the change of the output axis OA. Because of this action, the height of the lowest point of the needle 1*b* in the case of the left base line and in the case of the center base line becomes substantially consistent.

As explained above, by changing the position of the output axis OA, the trajectory of the needle bar 1 can be changed. That is, by changing the position on the center base line in FIG. 4 to the position on the right base line in FIG. 5, a correction that advances the needle bar phase on the right base line in comparison with the needle bar phase on the center base line is performed. Conversely, in the case of the left base line, a correction that retards the needle bar phase in comparison with that of the center base line is performed.

(3) Formation of Stitches

According to the sewing machine of this embodiment, with the upper thread being inserted in the needle hole 1*a* of the needle 1*b*, and the bobbin around which the lower thread is wound being retained in the internal shuttle, when the upper shaft 3 is driven, stitches are formed. More specifically, when the upper shaft 3 is driven by the first motor 5, the rotational motion of the upper shaft 3 is converted into a reciprocal motion by the slider crank mechanism. Hence, the needle bar 1 moves up and down. In addition, the rotation of the upper shaft 3 is transferred to the lower shaft 4 through the upper-shaft pulley 3*a*, the toothed belt 6, and the lower-shaft pulley 4*a*. When the lower shaft 4 is rotated together with the rotation of the upper shaft 3, the shuttle 2 is rotated.

Figure 12:
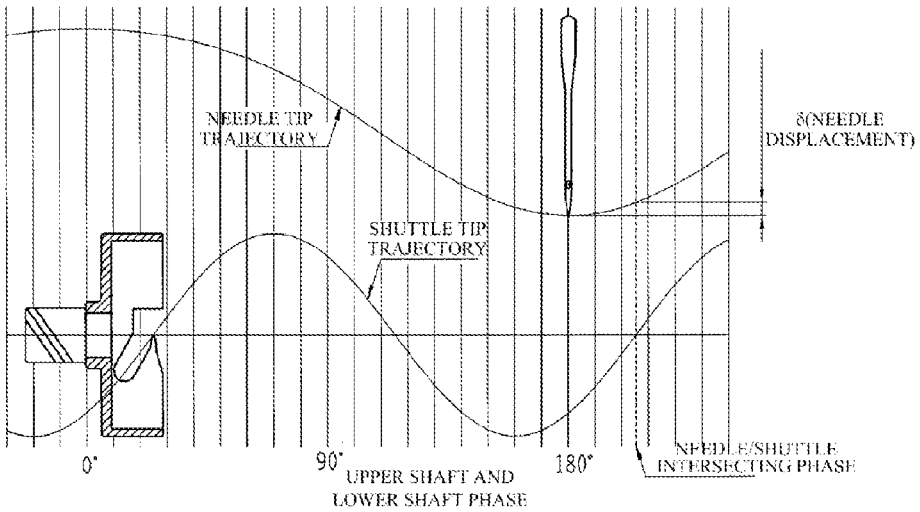
FIG. 12 is a diagram illustrating a relationship between a needle/shuttle intersecting phase and a needle displacement δ in a conventional sewing machine.

In such an operation, the needle 1*b* passes through a cloth, and moves to a needle lowest point. Subsequently, the needle 1*b* is raised on some level, but the upper thread cannot be pulled out from the top face of the cloth due to a friction therewith, and thus a thread loop is formed on the bottom face of the cloth. When the tip 2*a* of the external shuttle 2 passes through the thread loop, the bobbin around which the lower thread is wound passes through the thread loop, and the upper thread and the lower thread are intertwined with each other, thereby forming a stitch. A phase when the needle 1*b* and the tip 2*b* of the shuttle 2 intersect and the tip 2*b* catches the thread loop is defined as a needle/shuttle intersecting phase. FIG. 12 illustrates a correlation between the trajectory of the tip of the shuttle 2 and the needle/shuttle intersecting phase in the sewing machine. The horizontal axis indicates the phase of the upper shaft 3 and that of the lower shaft 4, while the vertical axis simulates the trajectory of the leading end of the needle 1*b* and that of the tip 2*b* of the external shuttle 2. In FIG. 12, the needle/shuttle intersecting phase is around 205 [°], and the amount of the raise of the needle 1*b* at the needle/shuttle intersecting phase from the bottom dead center will be defined as a needle displacement δ.

(3-1) Formation of Thread Loop

Figure 13:
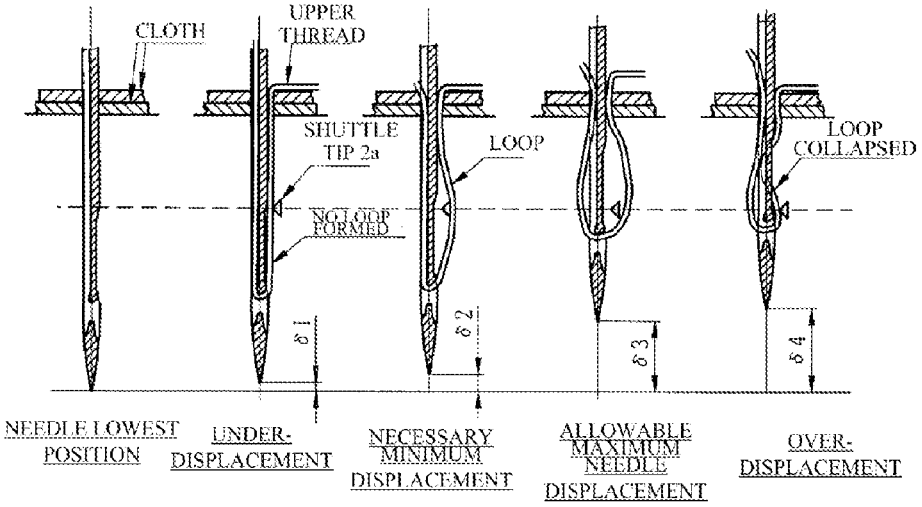
FIG. 13 is a diagram illustrating a necessary minimum needle displacement and an allowable maximum needle displacement to form an appropriate stitch in the sewing machine.

FIG. 13 is a diagram illustrating a formation of thread loop with each needle displacement δ. The size of the thread loop depends on the amount of the needle 1*b* raised from the lowest point. δ1 indicates an under-displacement of the needle 1*b*. When the displacement of the needle 1*b* is too small like δ1, it is difficult to form a thread loop, or even if the thread loop can be formed, the thread loop is too small, and the tip 2*a* cannot enter the thread loop. Conversely, δ4 indicates an over-displacement of the needle 1*b*. When the displacement of the needle 1*b* is too large like δ4, the thread loop becomes too large, and is collapsed due to the self-weight of the thread or twisting, and thus the tip 2*a* cannot enter the thread loop. As explained above, if the needle displacement is too small or too large, it is difficult to form a stitch.

Hence, in order to form an appropriate stitch, the needle displacement is required to be set so as to enable the formation of the thread loop, and to allow the tip 2*a* of the shuttle 2 to enter the thread loop. In FIG. 13, a necessary minimum displacement is indicated as δ2, and an allowable maximum displacement is indicated as δ3. In order to form an appropriate stitch, it is necessary to set the needle displacement to be equal to or larger than δ2 but equal to or smaller than δ3.

Figure 14:
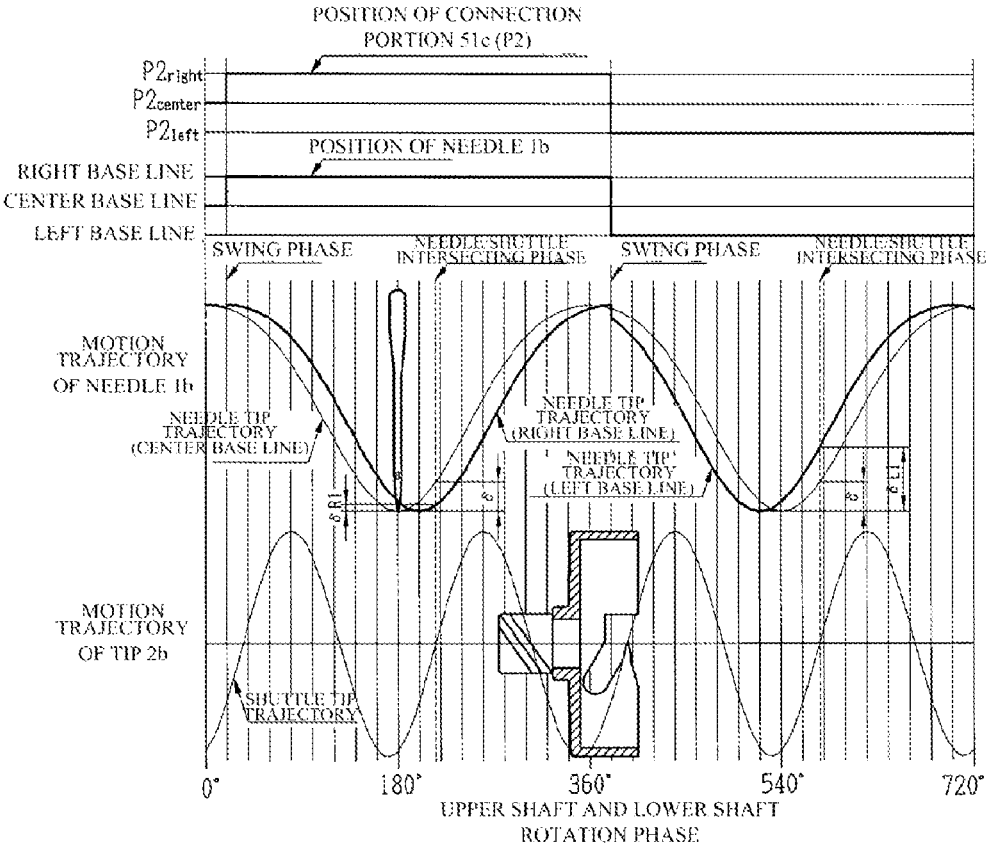
FIG. 14 is a diagram illustrating a change in needle displacement when the position of the needle bar changes in conventional sewing machines.

(3) Trajectory of Needle 1*b* at the Time of Zig-Zag Sewing by Conventional Sewing Machines The needle-bar swing mechanism swings the needle bar 1 by the drive force from the second motor 5*a* so as to intersect the cloth feeding direction, zig-zag stitches are formed. FIG. 14 illustrates, in conventional sewing machines, a change in the relative motion of the needle 1*b* and the tip 2*a* of the shuttle 2 when zig-zag sewing is performed. The horizontal axis in FIG. 14 indicates the phase of the upper shaft 3 and that of the lower shaft 4, while the vertical axis indicates the simulated trajectory of the leading end of the needle 1*b* and that of the tip 2*a* of the shuttle 2. The trajectory of the tip 2*a* is slightly different from an actual trajectory, but is illustrated with a continuous line for the purpose of explanation. In the example in FIG. 14, it is assumed that the shuttle 2 rotates in a counterclockwise direction.

In FIG. 14, the trajectory of the needle 1*b* illustrated by solid lines indicates that the needle-bar side-to-side swing unit is not actuated yet and the needle 1*b* is located on the center base line that is the center. In addition, the trajectory illustrated by thick lines indicates that the needle 1*b* swings from side to side by the needle-bar side-to-side swing unit. At the needle/shuttle intersecting phase in the figure, the needle 1*b* and the tip 2*a* are coming close to each other maximally. In such a needle/shuttle intersecting phase, the tip 2*a* enters the thread loop of the upper thread.

As explained above, in order to form a stitch, it is necessary to set the needle displacement to be equal to or larger than the necessary minimum displacement δ2, but equal to or smaller than allowable maximum displacement δ3. In the case of zig-zag sewing, however, the position of the shuttle 2 is constant but the needle 1*b* swings from side to side from the center base line, and thus the relative position of the needle 1*b* to the shuttle 2 changes. A change in the positional relationship affects the needle displacement.

When, for example, in conventional sewing machines, representing the needle displacement when the needle 1*b* is moved to the right side as δR1, δR1 is smaller than the needle displacement δ in the center-base-line condition. In addition, representing the needle displacement when the needle 1*b* is moved to the left side as δL1, δL1 becomes larger than the needle displacement δ in the center-base-line condition. That is, even if the needle displacement in the center-base-line condition is set to be an appropriate value, when the needle 1*b* swings from side to side, δR1 becomes smaller than the minimum necessary displacement δ2, or δL1 exceeds the allowable maximum displacement δ3, and thus it sometime becomes difficult to form an appropriate thread loop.

A change in the needle displacement due to a position change of the needle 1*b* increases in proportional to a swing amount Z of the needle 1*b* which swings from side to side. Hence, according to conventional sewing machines, a stitch can be formed only when the needle displacement satisfies a condition δ2<δR1<δ<δL1<δ3, the maximum swing amount Z is automatically determined. Hence, even if there is a need for sewing of a pattern that requires a larger swing amount than the automatically set value, there is a technical difficulty to meet such a need.

(3-3) Operation of Sewing Machine of this Embodiment

The following explanation will be given of how the whole sewing machine operates.

When zig-zag sewing is performed by the sewing machine of this embodiment, the position of the connection portion 51*c* is changed by drive force from the second motor 5*a*, thereby swinging the needle bar 1 from side to side. In addition, when the position of the connection portion 51*c* changes, the base line of the needle 1*b* and the position of the output axis OA also change.

According to the sewing machine of this embodiment, when zig-zag sewing is performed, also, as explained above, the needle displacement changes in accordance with the base line of the needle 1*b*. Conversely, the needle displacement also changes in accordance with the position of the output axis OA. The needle displacement of the sewing machine of this embodiment is a needle displacement obtained by synthesizing the needle displacement in accordance with the base line with the needle displacement in accordance with the position of the output axis OA.

(a) Needle Displacement in Accordance with Position of Output Axis OA

Figure 15:
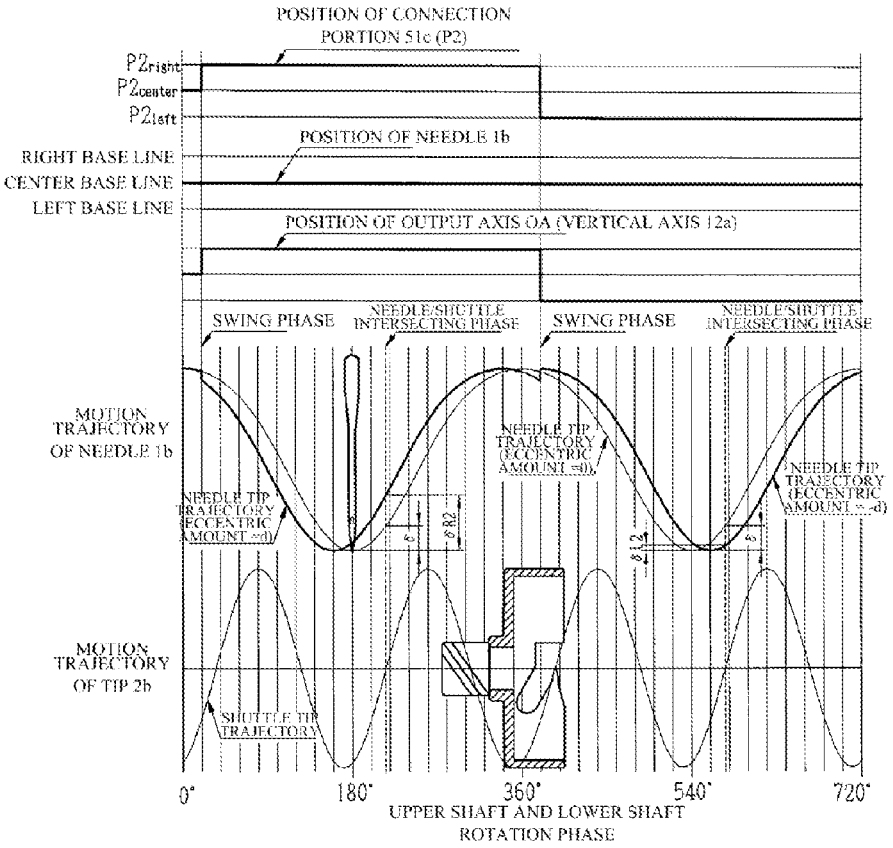
FIG. 15 is a diagram illustrating a change in needle displacement when the position of a guide changes in the sewing machine of the embodiment.

FIG. 15 illustrates a position of the connection portion 51*c*, a position of the output axis OA, and a phase of the needle 1*b* and that of the tip 2*b* in view of the needle displacement in accordance with a change in the position of the output axis OA. In FIG. 15, for the purpose of explanation, the needle displacement in accordance with a change in the base line of the needle 1*b* is out of consideration.

It is assumed that, as for the position of the output axis OA in FIG. 15, the position of the needle bar 1 when viewed in the X direction in FIG. 1 is a reference position 0. The upstream side of the cloth feeding direction relative to the reference position will be defined as a positive side, while the downstream side of the cloth feeding direction will be defined as a negative side.

As illustrated in FIG. 15, the connection portion 51*c* moves to $P2_{left}$ or $P2_{right}$ in accordance with a drive timing of the second motor 5*a*. At this time, the output axis OA also moves in accordance with the connection portion 51. When the connection portion 51*c* moves to $P2_{right}$, the output axis OA moves to a position at the upstream side of the cloth feeding direction apart from the reference position by a distance d. When the connection portion 51*c* moves to $P2_{left}$, the output axis OA moves to a position at the downstream side of the cloth feeding direction apart from the reference position by a distance d (−d).

A solid line in the motion trajectory of the needle 1*b* in FIG. 15 indicates the trajectory of the needle 1*b* when the output axis OA is located at the reference position 0. In this case, the connection portion 51*c* is always located on $P2_{center}$. That is, in the solid line in FIG. 15, the position of the output axis is unchanged. Hence, the motion trajectory representing the needle up-and-down movement becomes a waveform like a sinusoidal wave.

Conversely, a thick line in FIG. 15 indicates the trajectory of the needle 1*b* when the eccentric amount of the output axis OA is changed from 0 to d, and from d to −d. That is, it indicates the trajectory of the needle 1*b* when the connection portion 51*c* is moved from, as for the position of the output axis OA, $P2_{center}$ to $P2_{right}$, and from $P2_{right}$ to $P2_{left}$. When the eccentric amount of the output axis is set as d, the motion trajectory of the needle 1*b* has the advanced lowest point timing in comparison with the case in which the output axis OA is located at the reference position. Hence, the needle displacement δR2 in the needle/shuttle intersecting phase becomes a larger value than the needle displacement δR1. Conversely, by setting the eccentric amount of the output axis as −d, the motion trajectory of the needle 1*b* has a retarded lowest point timing in comparison with the case in which the output axis OA is located at the reference position. Hence, the needle displacement δL2 in the needle/shuttle intersecting phase becomes a smaller value than the needle displacement δL1.

Figure 16:
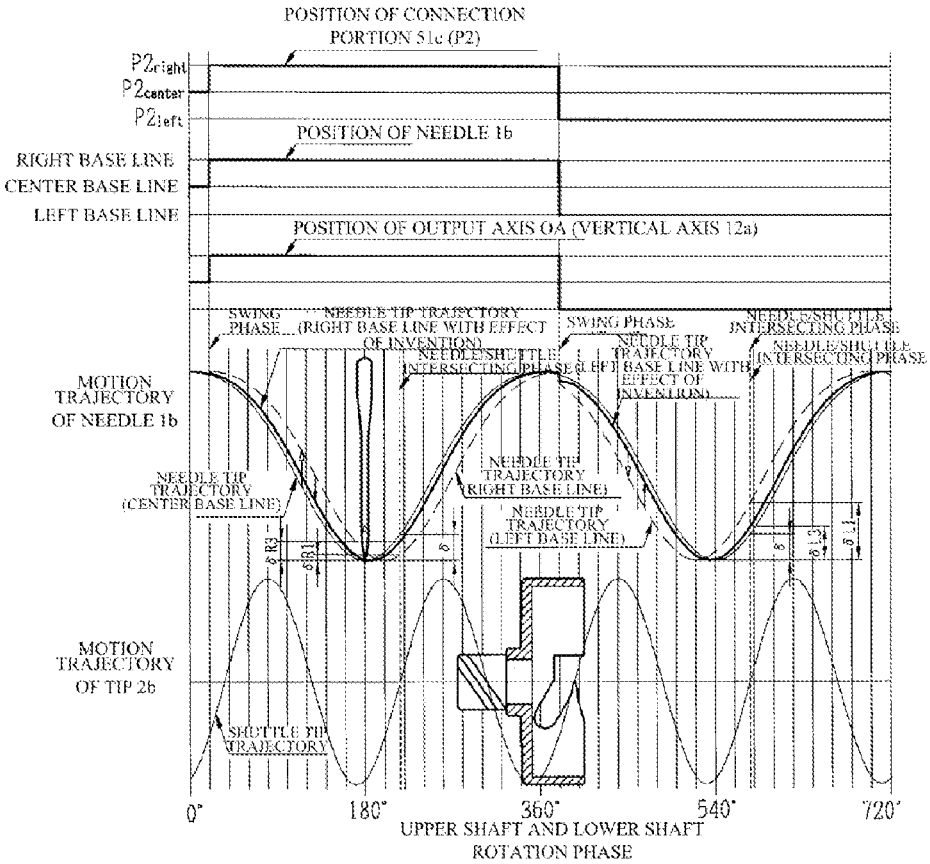
FIG. 16 is a diagram illustrating a change in needle displacement when the position of the needle bar and that of the guide simultaneously change in the sewing machine of the embodiment.

(b) Synthesis of Needle Displacement in Accordance with Base Line of Needle 1*b* with Needle Displacement in Accordance with Position of Output Axis OA A solid line in FIG. 16 indicates the motion trajectory of the needle 1*b* when the output axis OA is located at the reference position and the needle 1*b* is located on the center base line. The needle displacement in the needle/shuttle intersecting phase in the solid line of FIG. 16 is δ. A dashed line in FIG. 16 indicates the motion trajectory of the needle 1*b* when the base line of the needle is changed from side to side without changing the position of the output axis OA like the thick line in FIG. 14. The needle displacement in the case of the right base line in the needle/shuttle intersecting phase in the dashed line in FIG. 16 is δR1, and the needle displacement in the case of the left base line is δL1. The thick line in FIG. 16 indicates the trajectory of the needle 1*b* when the position of the output axis OA is changed in accordance with the base line of the needle.

As is indicated by the dashed line in FIG. 16, the needle lowest point timing is retarded in comparison with the case of the center base line. Hence, the needle displacement δR1 becomes smaller than the needle displacement δ. In this embodiment, the base line of the needle 1*b* is set to the right base line, and the position of the output axis OA is changed, thereby performing a correction of advancing the needle lowest point timing. The amount of correction by the change in position of the output axis OA approximates an amount of change in needle lowest point timing due to a change in base line of the needle 1*b*. Consequently, as is indicated by the thick line in FIG. 16, in this embodiment, although the position of the needle is on the right base line, the motion trajectory and the needle displacement approximate those when the needle is located on the center base line.

That is, as for the large/small relationship for the needle displacement on the right base line, a relationship $\delta R1<\delta\cong\delta R3<\delta R2$. Consequently, when, for example, the swing amount has the needle displacement δR1 that has become smaller than the necessary minimum displacement δ2, by changing the position of the output axis OA, the needle displacement δR3 can be set to be equal to or larger than the necessary minimum displacement δ2.

Likewise, with the position of the output axis being fixed to the reference position, when the base line of the needle 1*b* is changed to the left base line, as is indicated by the dashed line in FIG. 16, the needle lowest timing is advanced in comparison with the case of the center base line. Hence, the needle displacement δL1 becomes larger than the needle displacement δ. In this embodiment, the base line of the needle 1*b* is set to the left base line, and the position of the output axis OA is changed, thereby performing a correction of retarding the needle lowest point timing. Consequently, as is indicated by the thick line in FIG. 16, in this embodiment, although the position of the needle is located on the left base line, the motion trajectory and the needle displacement approximate those when the needle is located on the center base line. That is, the large/small relationship of the needle displacement in the case of the left base line satisfies a condition $\delta L2<\delta\cong\delta L3<\delta L1$. Consequently, when, for example, the amount swing has the needle displacement δL1 that has exceeded the allowable maximum displacement δ3, by changing the position of the output axis OA, the needle displacement can be reduced.

[1-3. Effect]

The sewing machine of this embodiment can accomplish the following effects.

As explained above, when zig-zag sewing is performed with a certain swing width, δR1 decreases in accordance with a swing amount Z, and δL1 increases. In order to forma stitch, it is necessary for the needle displacement to satisfy a condition $\delta 2<\delta R1<\delta<\delta L1<\delta L3$. Hence, the maximum value of the swing amount Z automatically falls to a limited value. Conversely, according to this embodiment, by changing the position of the output axis OA, the needle displacement of the needle 1*b* is corrected. Accordingly, in the case of the swing amount that has the needle displacement which satisfies a condition $\delta R1<\delta 2<\delta<\delta 3<\delta L1$, the needle displacement δR3 obtained by correcting the needle displacement δR1 can be set to be equal to or larger than δ2, and the needle displacement δL3 obtained by correcting the needle displacement δL1 can be set to be equal to or smaller than δ3.

Hence, according to the sewing machine of this embodiment, the needle displacement can satisfy a condition $\delta 2<\delta R3<\delta<\delta L3<\delta 3$ at the swing amount that does not permit a formation of a stitch in conventional technologies. Hence, zig-zag sewing and pattern sewing with a wider swing width than conventional technologies are enabled, and thus it becomes possible for the sewing machine to provide a larger number of choices of sewing patterns to the user of the sewing machine.

In addition, according to this embodiment, the height of the needle 1*b* in accordance with the change of the position of the output axis OA is corrected by the assist rod 13. Hence, even if the base line of the needle is changed, the position of the lowest point of the needle 1*b* and that of the highest point thereof are substantially unchanged. Accordingly, regardless of the position of the needle 1*b* in the swing operation, the positional relationship between the needle and the shuttle in the vertical direction remains the same. That is, the needle displacement and the position relationship in the vertical direction between the needle and the shuttle which are optimized on the center base line can be maintained well even if the position of the needle changes, and thus a stitch can be surely formed.

Still further, according to the sewing machine of this embodiment, since the positional relationship and operation direction of the major components, such as the upper shaft 3, the needle-bar crank 7, and the needle-bar support 5*c* are not modified, and thus the above effects can be accomplished without a large modification to the designing of conventional sewing machines.

2. Other Embodiments

Although the embodiment of the present invention was explained above, various omissions, replacements, and modifications can be made without departing from the broadest scope of the present invention. Such embodiments and modified forms thereof should be within the scope of the present invention, and also within the scope of the invention as recited in appended claims and the equivalent range thereto.

(a) The embodiment illustrated in FIG. 1 utilizes an outline diagram. Hence, portions not directly relevant to the present invention or general designs are partially omitted in the figure, and the detailed explanation is omitted. For example, the connection portion 51*c* of the second motor 5*a* performs an arc motion around the rotation shaft 51*a*, but the swing rod 5*b* driven by the connection portion 51*c* is illustrated so as to perform a linear motion in the horizontal direction (Z direction). In a precise sense, drive force of the arc motion by the connection portion 51*c* in the camber direction (Z direction) is also transferred to the swing rod 5*b*, and the swing rod 5*b* is also driven in the vertical direction (Z direction). However, the connection portion of the swing rod 5*b* with the connection portion 51*c* is illustrated as a circular hole in the figure, but this hole may be, for example, an elongated hole in the Z direction to absorb the drive force in the camber direction.

(b) In the embodiment, the guide 12 rotates while maintaining the parallel relationship with the guide shaft 11. However, when, for example, there is an inconvenience over designing, an oscillator mechanism like the guide shaft 11 and the needle-bar support 5*c* may be employed. As explained above, as long as the operation of the guide 12 on the substantial rotation plane of the needle-bar crank 7 is maintained, the effect to the present invention originating from the oscillator mechanism is little, and substantially same effects can be accomplished.

(C) In addition, in the embodiment, the guide 12 is moved to a position where the respective extended center axes of the guide 12 and the upper shaft 3 intersect or do not intersect, thereby changing the motion trajectory of the needle bar 1. However, due to the restriction over designing, even if there is a positional relationship that has the respective extended center axes of the support 12 and the upper shaft 3 do not always intersect, the effects of the present invention can be still obtained as long as a mechanism that can increase/decrease the eccentric amount d.

(d) In the embodiment, zig-zag stitches are formed using the two motors that are the first motor 5 which swings the needle bar 1 up and down, and the second motor 5*a* which swings the needle bar 1 from side to side, but the number of drive motors is not limited to two. For example, the number of motors may be one, and only the first motor may be employed. Drive force from such a motor may be transferred to the needle-bar up-and-down swing unit, and also to the needle-bar side-to-side swing unit, and a certain operation pattern may be given to the needle-bar side-to-side swing unit through, for example, a disc cam. According to this structure, the same effects as those of the above embodiment can be accomplished using only one motor. As for the advantage of this structure, since the number of motors is only one, it is unnecessary to obtain a synchronization of motors, and thus the control for the motor can be simplified.

(e) In the embodiment, the guide 12 is operated by the operation of the swing rod 5*b*, but other methods are applicable. For example, two mechanical elements, such as a linkage, a gear, a cam and a pulley, may be provided to the motor shaft of the motor 5*a*, and the respective elements may be utilized to drive the needle-bar support 5*c* and the support 12. The same effects can be also accomplished in this case.

(f) In the embodiment, the explanation was given of a case in which a horizontal shuttle that is the shuttle 2*a* rotates in the horizontal direction is applied, but it is unnecessary that the shuttle is the horizontal shuttle. For example, the same effects of the embodiment can be accomplished when the shuttle is a vertical shuttle that rotates in the horizontal direction.

What is claimed is:

1. A sewing machine that moves, relative to a cloth, a needle attached to a needle bar up and down based on drive force from a rotating upper shaft to form a stitch, the sewing machine comprising:

a needle-bar swing unit swinging the needle bar in an orthogonal direction to a cloth feeding direction;

a first output generating unit reciprocating a first output point along an output axis that swings in accordance with a swing operation of the needle by the needle-bar swing unit;

a link unit linking the first output point with the needle bar; and an output axis moving unit moving the output axis in the cloth feeding direction in accordance with an operation of the needle-bar swing unit, wherein the first output generating unit comprises:

a crank provided at the upper shaft;

a crank rod having one end connected with the crank and other end serving as the first output point; and an assist rod connected to the other end of the crank rod so as to be freely rotatable, and the link unit changes an inclination in accordance with the movement of the output axis, and moves up and down the needle bar in substantially parallel with the output axis while maintaining the inclination.

2. The sewing machine according to claim 1, wherein the needle-bar swing unit comprises:

a second output generating unit moving a second output point in an orthogonal direction to the cloth feeding direction; and a swing rod transferring a change in a position of the second output point to the needle bar.

3. The sewing machine according to claim 2, wherein:

the output axis moving unit comprises a guide which is connected with the swing rod, and which rotates around and moves relative to a guide shaft extending in a vertical direction, and the other end of the crank rod moves in accordance with a movement of the guide.

4. The sewing machine according to claim 3, wherein:

the guide comprises two arms each forming a constant angle;

one of the arms is connected so as to be freely rotatable relative to the swing rod;

a vertical axis in parallel with the guide shaft is disposed at a leading end of an other arm; and the other end of the crank rod is connected so as to be freely rotatable relative to the vertical axis.

5. The sewing machine according to claim 1, further comprising a shuttle supplying a lower thread while rotating in a horizontal or vertical direction, wherein, when the needle bar rotates in an opposite direction to a rotation direction of the hook, the vertical shaft swings so as to come close to the hook.

* * * * *